United States Patent [19]

Ruhrmann

[11] 4,161,053

[45] Jul. 17, 1979

[54] AUTOMATIC-LOCK SLIDER FOR SLIDE FASTENER

[75] Inventor: Wolfgang Ruhrmann, Stuttgart, Fed. Rep. of Germany

[73] Assignee: Gundel Ruhrman, Stuttgart, Fed. Rep. of Germany

[21] Appl. No.: 792,597

[22] Filed: May 2, 1977

[30] Foreign Application Priority Data

May 11, 1976 [DE] Fed. Rep. of Germany ..... 2620682

[51] Int. Cl.[2] ..... A44B 19/30

[52] U.S. Cl. ..... 24/205.14 R

[58] Field of Search ..... 24/205.14 R, 205.14 K

[56] References Cited

U.S. PATENT DOCUMENTS

| | | | |
|---|---|---|---|
| 2,018,948 | 10/1935 | Corner | 24/205.14 K |
| 2,450,550 | 10/1948 | Griffin | 24/205.14 R |
| 3,080,632 | 3/1963 | Holman | 24/205.14 R |
| 3,798,714 | 3/1974 | Mueller | 24/205.14 R |

FOREIGN PATENT DOCUMENTS

| | | | |
|---|---|---|---|
| 230025 | 8/1960 | Australia | 24/205.14 R |
| 1075066 | 2/1960 | Fed. Rep. of Germany | 24/205.14 R |
| 659290 | 10/1951 | United Kingdom | 24/205.14 R |
| 978831 | 12/1964 | United Kingdom | 24/205.14 R |
| 1377451 | 12/1974 | United Kingdom | 24/205.14 R |

*Primary Examiner*—Bernard A. Gelak

*Attorney, Agent, or Firm*—Toren, McGeady and Stanger

[57] ABSTRACT

A slide fastener slider whose flanged top and bottom plates are fixedly connected by a wedge or neck to define a branched passage for a slide fastener chain through the slider. A latch is secured to the top plate outside the passage for angular movement about an axis transverse to the normal direction of slider movement. The latch includes a detent passing through an aperture in the top plate and having first and second opposite faces transverse to the direction of slider movement which converge inward of the passage toward a free end of the detent, the first detent face being directed away from the neck. Abutments on the top plate and the latch limit the angular movement of the latter. In one terminal latch position, the first detent face is approximately perpendicular to the direction of chain movement in the passage, and the free end of the detent projects into the slider passage and toward the bottom plate. In the other terminal position, the end of the detent projects farther into the passage and is nearer the bottom plate then in the one position. A pull is secured to the latch.

7 Claims, 2 Drawing Figures

AUTOMATIC-LOCK SLIDER FOR SLIDE FASTENER

This invention relates to slide fasteners, and particularly to a slider which automatically locks to the fastener chain to prevent accidental opening of the fastener.

Known automatic-lock sliders are not always durable. While they may function well when new, wear or deformation of the locking mechanism limits their useful life. Other known automatic-lock sliders which function adequately as long as other fastener elements are relatively complex and correspondingly costly.

It is a primary object of this invention to provide an automatic lock slider for a slide fastener which is simple in its structure, and therefore capable of being made at low cost, yet rugged and durable.

With this object and others in view, as will hereinafter become apparent, the slider of the invention includes the conventional flanged top and bottom plates fixedly connected by a neck or wedge member at one end of the passage extending through the slider between the plates and transversely divided by the neck into two branches. A latch is hingedly secured to the top plate outside the slider passage and includes a detent passing through an aperture in the top plate. Two opposite faces of the detent are directed respectively toward and away from the neck and converge inward of the passage toward a free end of the detent. Cooperating abutments on the top plate and the latch limit angular movement of the latch. In one angularly terminal unlocking position of the latch, the detent face directed away from the neck is approximately perpendicular to the normal direction of slider movement, and the free end of the detent projects slightly into the passage. In the other angularly terminal locking position of the latch, the free detent end projects relatively far into the slider passage and is nearer the bottom plate than in the unlocking position. A pull is secured to the latch.

Figure 1:
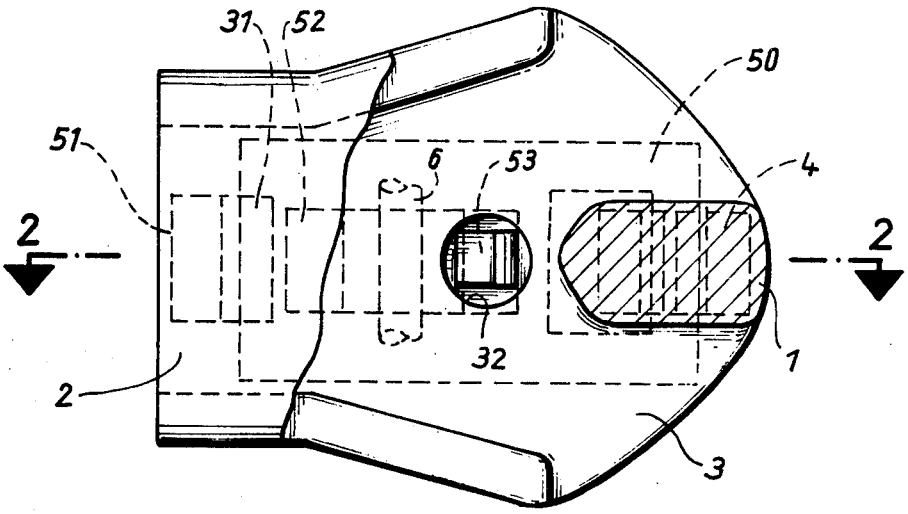
Figure 2:
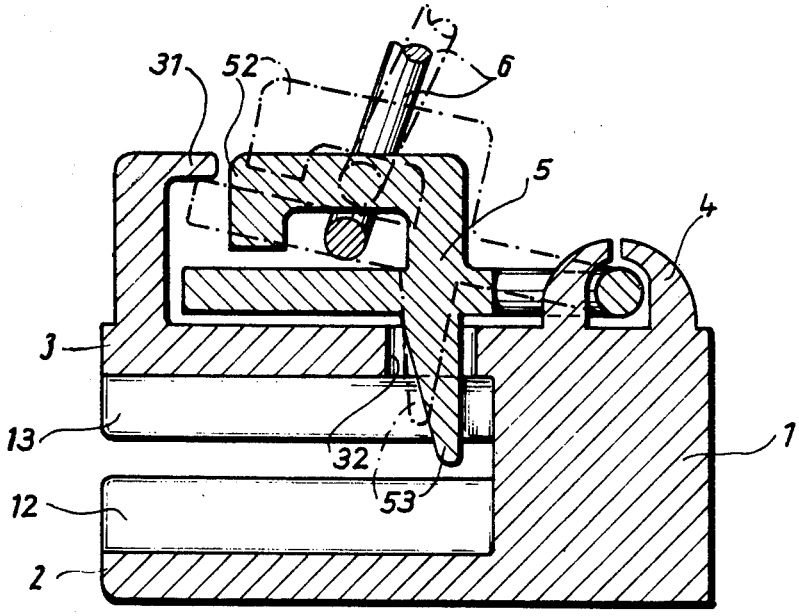

Other features and many of the attendant advantages of this invention will readily be appreciated as the same becomes better understood by reference to the following detailed description of a preferred embodiment when considered in connection with the appended drawing in which:

FIG. 1 shows a slider of the invention with partly broken away bottom plate in a bottom view; and FIG. 2 illustrates the slider of FIG. 1 in side-elevational section on the line 2—2.

The illustrated slider consists of two pressure castings of zinc alloy or other metal. One casting constitutes the slider body and includes the wedge-shaped slider neck 1 which fixedly connects a bottom plate 2 and a top plate 3. Two lateral flanges 12 project from the bottom plate 2 toward corresponding flanges 13 depending from the top plate 3. In normal operation of the slider, two fastener stringers pass through the partly branched path in the slider defined by the plates 2, 3, their flanges 12, 13, and the neck 1, the neck and flanges guiding the interlocking elements of the non-illustrated stringers into and out of engagement as is conventional in itself.

Two lugs 4 project from the outer face of the top plate 3 above the neck 1 and converge to provide a bearing for a carrier portion 50 of a latch 5 which is another unitary pressure casting. The carrier portion 50 is a flat, rectangularly elongated plate, apertured and partly rounded for engagement by the bearing lugs 4.

The narrow end of the carrier portion 50 remote from the bearing lugs 4 is loosely confined between the outer, top face of the plate 3 and a spacedly opposite face of an abutment 31 integral with the top plate 3 and upwardly projecting from the same.

A hook 52 integrally projects from a central part of the carrier portion 50 and extends close to the abutment member 31 in all angular positions of the latch 5. A wire ring 6, only partly shown, is movably retained in the bight of the hook 52 as a pull.

A detent 53 extends from the central part of the carrier portion 50 through a cylindrical aperture 32 in the top plate 3 into the passage of the slider body. At its root, near the carrier portion 50, the detent 53 is approximately square in cross section, as is best seen in FIG. 1. It has two planar faces transverse to the direction of normal slider movement and directed toward the neck 1 and away from the neck 1 respectively. These faces converge inward of the passage in the slider body toward the free end of the detent 53 adjacent the bottom plate 2.

The shapes and dimensions of the aperture 32 and the detent 53 are such that the planar, transverse face of the detent 32 directed toward the neck 1 abuts against the wall of the top plate 3 in the aperture 32 in the fully drawn locking position of the latch, and the free end of the detent 53 deeply penetrates into the slider passage. When the detent is tilted manually by means of the pull 6 into the unlocking position indicated in FIG. 2 in chain-dotted lines and defined by abutting engagement of the carrier portion 50 with the abutment member 31, the planar transverse face of the detent 53 directed away from the neck 1 is approximately perpendicular to the direction of slider movement, and the free end of the detent is retracted upward from the locking position. It still projects sufficiently into the slider passage frictionally to engage the interlocking fastener elements, not themselves shown in the drawing.

The aperture 32 and the detent 53 are closely adjacent the neck 1. The distance of the neck from the aperture is much smaller than the dimension of the aperture in the direction of slider movement, and the distance of the detent 53 from the neck is about equally small when the detent is in the locking position, and not much greater than the aperture dimension in the unlocking position of the detent. As is evident from FIG. 1, the width of the neck 1 is more than twice the width of the detent 53.

When the detent 53 is in the locking position, the two stringers of the fastener chain normally projecting from the branch passages of the slider body separated by the neck 1 cannot be pulled out of the slider because the detent is caught between engaged chain elements or abuts against the last engaged element. When the detent is in the unlocking position, its planar transverse face directed away from the neck 1 is frictionally engaged by a fastening element during initial opening movement of the latter, and the latch 5 is tilted into the locking position, thereby preventing any further chain movement in the opening direction. When the slider is moved toward the left, as viewed in FIG. 2, by traction applied to the pull ring 6, the free end of the detent 53 in the unlocking position does not interfere with the slider movement.

While it is preferred that counter-clockwise movement of the latch 5, as view engagement between the detent 53 and the top plate 2 in the aperture 32 to maintain the illustrated flush relationship of the abutment member 31 and the hook 52 in the locking position, wear of the initial abutment surfaces does not make the slider inoperative. The carrier portion 50 is prevented from moving far from the illustrated locking position by the top face of the top plate 3.

Other abutment arrangements for limiting the angular movement of the latch 5 may be resorted to if desired for any reason. Thus, the detent face directed away from the neck 1 may engage the material of the top plate 3 before the carrier portion 50 strikes the abutment member 31. Alternatively, the journal part of the carrier portion 50 and the bearing lugs 4 may be shaped in an obvious manner to limit angular movement of the latch.

Conventional zinc die-casting alloys are the preferred materials of construction for the slider body and latch of the invention at this time, particularly for relatively heavy fasteners. However, other materials, particularly plastics and sheet metal may be employed without basically changing the inventive features of the slider.

The illustrated slider is symmetrical relative to the plane of FIG. 2, but this is not a necessary feature of this invention. Fewer than four flanges 12, 13 may be provided, as is well known, and the provision of flanges on only one of the two plates 2, 3 is specifically contemplated.

It should be understood, therefore, that the foregoing disclosure relates only to a preferred embodiment of the invention, and that it is intended to cover all changes and modifications of the example of the invention herein chosen for purpose of the disclosure which do not constitute departures from the spirit and scope of the invention set forth in the appended claims.

What is claimed is:

1. An automatically locking slider for a slide fastener consisting essentially of:

(a) a slider body of rigid material including a top plate, a bottom plate, and a wedge fixedly connecting said plates, (1) said plates defining therebetween a path for passage of a slide fastener stringer through said slider body in a predetermined direction, said wedge dividing a terminal portion of said path into two branches, and at least one of said plates including flange means bounding said path transversely to said direction, (2) said top plate being formed with an aperture communicating with said path;

(b) a latch of rigid material secured to said top plate outside said path for free pivoting movement about an axis transverse to said direction, (1) said latch including a detent passing through said aperture and having two opposite faces transverse to said direction, a first one of said faces being directed away from said wedge, and the second face being directed toward said wedge, (2) said faces converging inward of said path toward a free end of said detent, (3) respective integral abutment portions of said top plate and of said latch engaging each other for limiting said pivoting movement to an unlocking position and a locking position, (4) in said unlocking position of said latch, said first face being approximately perpendicular to said direction, and said free end projecting from said aperture into said path and toward said bottom plate, (5) in said locking position of the latch, said free end farther projecting into said path and being nearer said bottom plate and said wedge than in said unlocking position, (6) whereby said free end frictionally engages said stringer during movement of said stringer in said path in a direction away from said wedge without preventing such movement when said latch is in the unlocking position, the latch is pivoted by the engaged stringer from the unlocking position into the locking position when the stringer moves in said path toward the wedge and thereafter prevents further stringer movement toward said wedge; and (c) a pull member secured to said latch.

2. A slider as set forth in claim 1, further comprising a bearing on said top plate adjacent said wedge pivotally receiving a portion of said latch.

3. A slider as set forth in claim 2, wherein said detent is received in said aperture with a clearance sufficient for movement of said latch between said positions, said detent abuttingly engaging said top plate in said aperture in one of said positions.

4. A slider as set forth in claim 1, wherein said aperture is aligned with said wedge in said direction and is spaced from said wedge a distance smaller than the dimension of said aperture in said direction.

5. A slider as set forth in claim 4, wherein the spacing of said free end from said wedge in said locking position of the latch is not greater than said dimension of said aperture.

6. A slider as set forth in claim 1, wherein said top plate carries a bearing adjacent said wedge member, said latch includes an elongated carrier portion, one longitudinally terminal part of said carrier portion being pivotally secured to said bearing, the other longitudinally terminal part constituting said abutment portion of said latch, said detent being fixedly fastened to a longitudinally central part of said carrier portion.

7. A slider as set forth in claim 6, wherein said latch includes a hook portion projecting from said central part of said carrier portion and engaging said pull member.

* * * * *